US009097083B2

(12) United States Patent
Belew et al.

(10) Patent No.: US 9,097,083 B2
(45) Date of Patent: Aug. 4, 2015

(54) METHOD AND APPARATUS FOR MILLING A ZERO RADIUS LATERAL WINDOW IN CASING

(75) Inventors: David Belew, Midland, TX (US); Jack J. Kolle, Seattle, WA (US); Mark H. Marvin, Tacoma, WA (US)

(73) Assignee: David Belew, Midland, TX (US)

( * ) Notice: Subject to any disclaimer, the term of this patent is extended or adjusted under 35 U.S.C. 154(b) by 747 days.

(21) Appl. No.: 13/328,111

(22) Filed: Dec. 16, 2011

(65) Prior Publication Data

US 2012/0160493 A1 Jun. 28, 2012

Related U.S. Application Data

(60) Provisional application No. 61/426,345, filed on Dec. 22, 2010.

(51) Int. Cl.

| | |
|---|---|
| ***E21B 43/11*** | (2006.01) |
| ***E21B 17/20*** | (2006.01) |
| ***E21B 7/06*** | (2006.01) |
| ***E21B 29/06*** | (2006.01) |
| ***E21B 7/04*** | (2006.01) |

(52) U.S. Cl.

CPC ..... *E21B 29/06* (2013.01); *E21B 7/046* (2013.01); *E21B 7/061* (2013.01); *E21B 17/20* (2013.01)

(58) Field of Classification Search

CPC ..... E21B 7/061; E21B 7/046; E21B 7/06; E21B 29/06; E21B 17/20

USPC ..... 175/61, 73, 320, 62, 107, 172, 77, 78, 175/81, 82, 79; 166/298, 55.2

See application file for complete search history.

(56) References Cited

U.S. PATENT DOCUMENTS

| | | | | |
|---|---|---|---|---|
| 2,669,429 | A * | 2/1954 | Zublin | 175/74 |
| 5,085,283 | A | 2/1992 | Seabourn et al. | |
| 6,220,372 | B1 * | 4/2001 | Cherry | 175/81 |
| 6,920,945 | B1 | 7/2005 | Belew et al. | |
| 6,964,303 | B2 * | 11/2005 | Mazorow et al. | 166/298 |
| 2007/0125577 | A1 * | 6/2007 | Brunet | 175/62 |
| 2008/0110629 | A1 * | 5/2008 | Belew et al. | 166/298 |
| 2009/0114449 | A1 | 5/2009 | Misselbrook et al. | |

FOREIGN PATENT DOCUMENTS

EP 0492457 A2 7/1992

OTHER PUBLICATIONS

The PCT Search Report and Written Opinion mailed Sep. 5, 2012 for PCT Application No. PCT/US11/66139, 13 pages.

* cited by examiner

*Primary Examiner* — Jennifer H Gay
*Assistant Examiner* — George Gray
(74) *Attorney, Agent, or Firm* — Lee & Hayes, PLLC

(57) ABSTRACT

A flexible milling assembly for milling an orifice through a well casing. The milling assembly can include a drive yoke, and a plurality of straight and split yoke assemblies—all linked together and to a cutter head with universal blocks that enable the components to pivot relative to each other. A string of joint tubing connected to a prime mover on the surface is used to lower the milling assembly into a well and supply the driving torque. A split shoe coupled to a guide tube is positioned within the well casing where the orifice is to be milled. The milling assembly is guided through a curved passage within the split shoe to bring the cutter head into contact with the well casing. A protector assembly can be provided to enclose and protect the milling assembly when it is tripping into and out of the well casing.

12 Claims, 4 Drawing Sheets

SECTION 1A-1A

FRONT

SIDE

SECTION B-B

SECTION 6A-6A

METHOD AND APPARATUS FOR MILLING A ZERO RADIUS LATERAL WINDOW IN CASING

RELATED APPLICATION

This application is based on a prior provisional application Ser. No. 61/426,345, filed on Dec. 22, 2010, the benefit of the filing date of which is hereby claimed under 35 U.S.C. §119 (e).

BACKGROUND

Oil and gas wells commonly bypass significant productive formations that may be uneconomic to complete at the time the wells were drilled. These formations may be relatively thin and low pressure so simply perforating a zone that includes oil does not provide significant new production. Lateral drilling tools have been developed that are capable of drilling formations using rotary mechanical or jetting tools. Lateral drilling into thin, horizontal oil bearing formations can result in substantial new oil production. The lateral well must be drilled at an angle as close as possible to 90 degrees to ensure that the lateral drilling tools stay within the productive zone and can be achieved by feeding a flexible lance though a shoe that curves to form a right angle, directing the lance into the formation. This approach is referred to as zero radius lateral drilling, since the angle is built entirely within the casing as opposed to being formed by drilling a curved hole in the formation.

In the event that the well is cased, lateral drilling requires milling a window in the steel casing before the lateral drilling tool is introduced. Zero radius lateral drilling requires milling a circular or slightly elliptical window in the casing. The milling assembly is preferably directed toward the casing through the same curved shoe that will be used to direct the lateral drilling lance. The shoe incorporates a tight radius curve, providing a near 90 degree turn within the inner diameter (ID) of the casing. The shoe can be set using conventional mechanical or hydraulic packers to ensure that a stable hole location for the jetting assembly is achieved, once the milling is completed.

Milling the steel casing requires substantial torque at relatively low rotary speed. The tool can be rotated by using a rotary table and drillstring, or by using a downhole motor. The thrust, torque, and rotary motion must be transmitted though a flexible assembly that will pass though the shoe. A number of approaches have been developed to achieve this goal; however, all have met with substantial practical difficulties.

It would thus be desirable to provide a method and apparatus for milling such a lateral window in a drill casing that avoids the problems experienced in the earlier attempted approaches.

SUMMARY

The concepts disclosed herein achieve a flexible milling assembly that is capable of transmitting sufficient torque and thrust to mill though a steel casing of the type commonly found in oil and gas wells. In this approach, a milling head and flexible shaft comprising a series of yokes joined by universal joint blocks that enable the assembly to flex and rotate, while transmitting substantial thrust and torque to a milling cutter head.

A number of features of this exemplary approach address the challenge of milling casing in a well thousands of feet below the surface.

The milling depth is typically less than one inch, but the milling assembly must be suspended on thousands of feet of steel tubing, which supplies the rotation, thrust and reactive torque. The tubing string stretches under its own weight and expands as it heats so that the location of the milling head relative to the shoe and casing wall is not precisely known. The milling assembly must be lowered into the well at a fast rate but must then come into contact with the casing while moving at a low rate. Accordingly, it is important to provide an apparatus and method for detecting when the milling assembly has entered the curved shoe, so that the operator can slow the feed rate at an appropriate point in the process and initiate milling without damaging the milling cutter head.

The flexible joint assembly must be guided though the shoe with minimal torque, since excessive torque can cause the flexible joint assembly to lock up, stop milling and/or become damaged. In one exemplary embodiment, bearing features on the flexible shaft support the assembly within the shoe passage to maintain alignment of the universal joints, while minimizing friction. The concepts disclosed herein also encompass practical means for assembling the flexible joint assembly so as to provide maximum axial thrust and torsion capacity.

The mill must penetrate a curved surface (i.e., the casing wall) at an angle, and the exemplary embodiment disclosed herein includes a structural arrangement of cutters, and cuttings relief slots that prevent binding while the milling cutter head is initiating the cut and completing the cut. The exemplary embodiments disclosed herein also encompass an arrangement of flexible milling shaft bearings that provide the support needed to initiate and complete the cut, without causing the milling assembly to bind.

The concepts disclosed herein further encompass a method and apparatus for detecting and confirming that the mill has successfully penetrated the casing so that a lateral mill or coring head can be deployed though the casing window.

Another aspect of this of this novel approach is directed to a method for controllably milling an orifice through a well casing in a borehole. The flexible milling assembly is rapidly lowered down the borehole within a guide tube, and the rate of descent of the flexible milling assembly is slowed as it approaches an entry into the curved passage in the shoe. In response to detecting that the flexible milling assembly is advancing into the curved passage, both an increasing rotational drive torque and an increasing thrust is applied to the flexible milling assembly, so that the cutter head on its distal end begins milling the orifice through the well casing.

This Summary has been provided to introduce a few concepts in a simplified form that are further described in detail below in the Description. However, this Summary is not intended to identify key or essential features of the claimed subject matter, nor is it intended to be used as an aid in determining the scope of the claimed subject matter.

DRAWINGS

Various aspects and attendant advantages of one or more exemplary embodiments and modifications thereto will become more readily appreciated as the same becomes better understood by reference to the following detailed description, when taken in conjunction with the accompanying drawings, wherein.

Figure 5A:
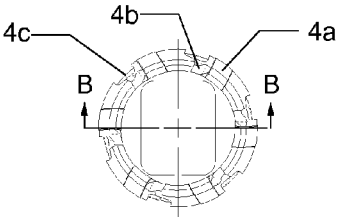
Figure 5B:
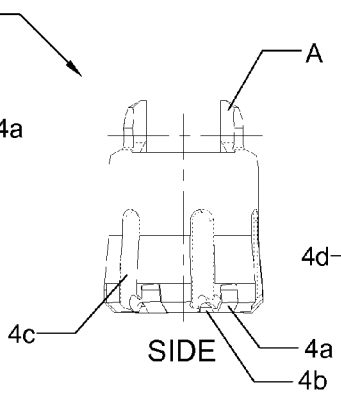
Figure 5C:
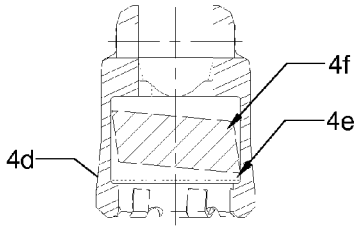
Figure 6C:
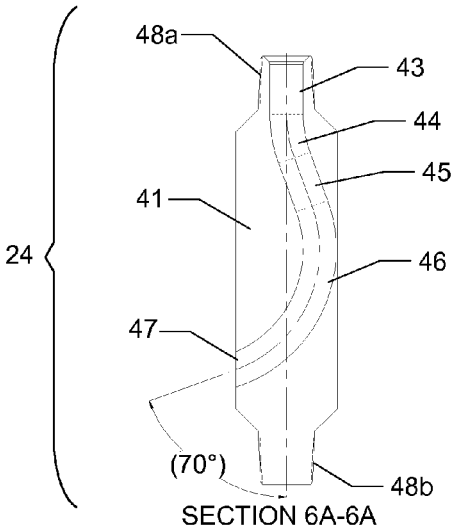
Figure 6A:
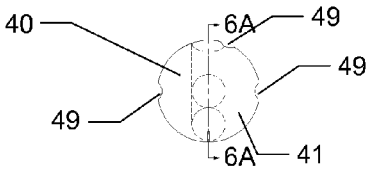
Figure 6B:
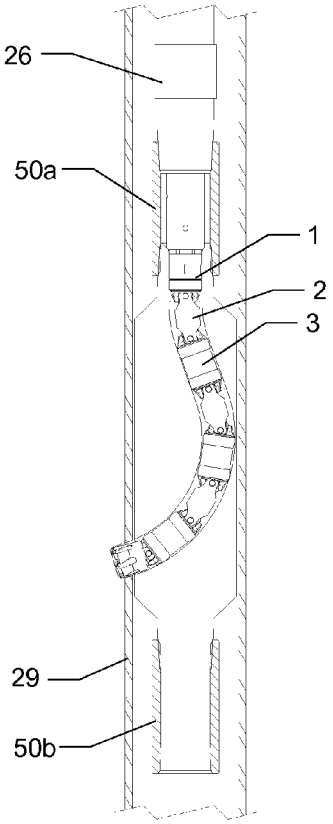
Figure 7:
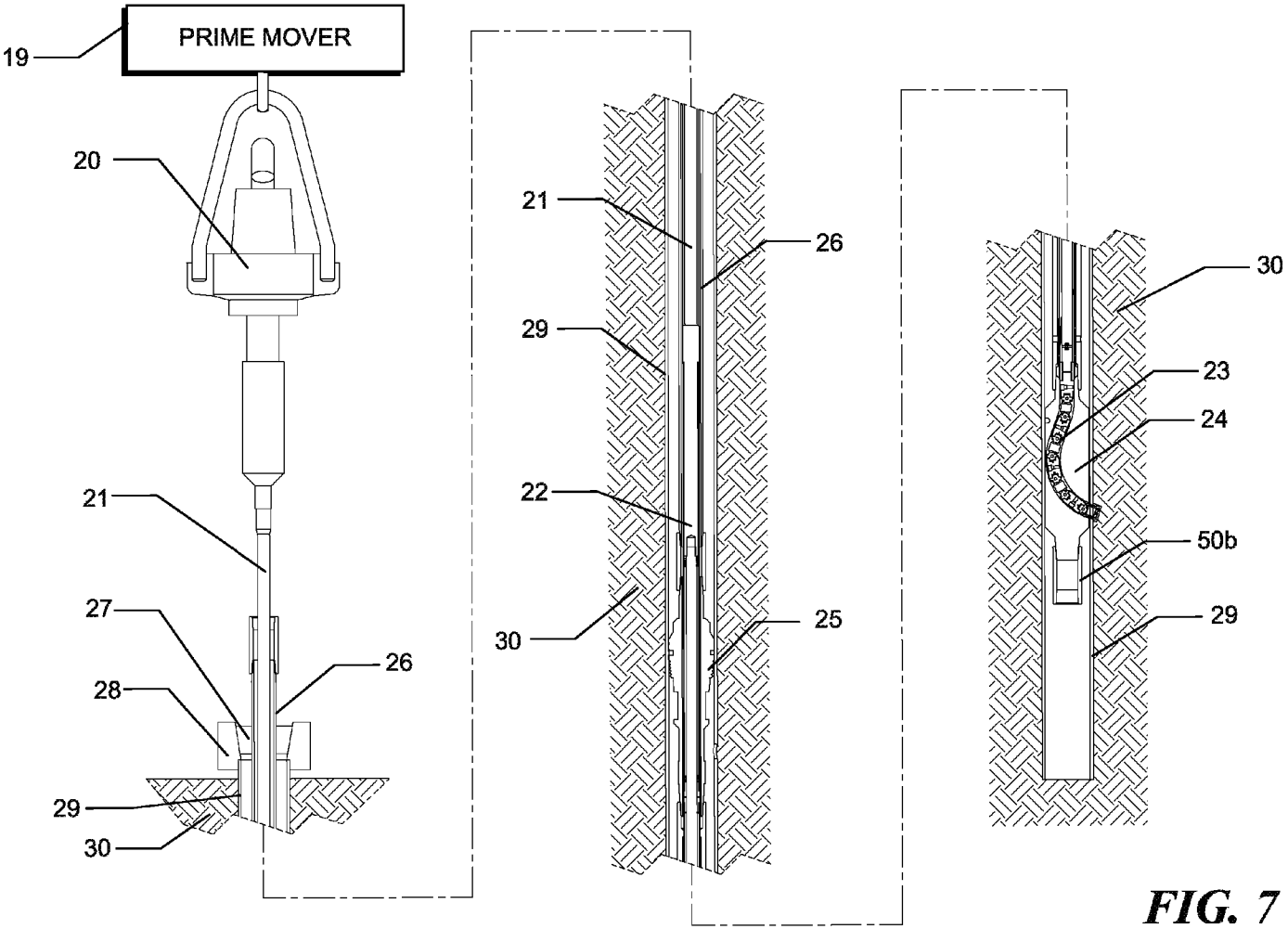
Figure 8C:
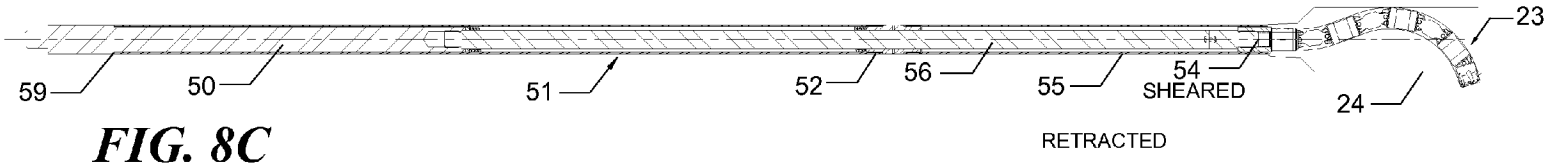
Figure 8B:
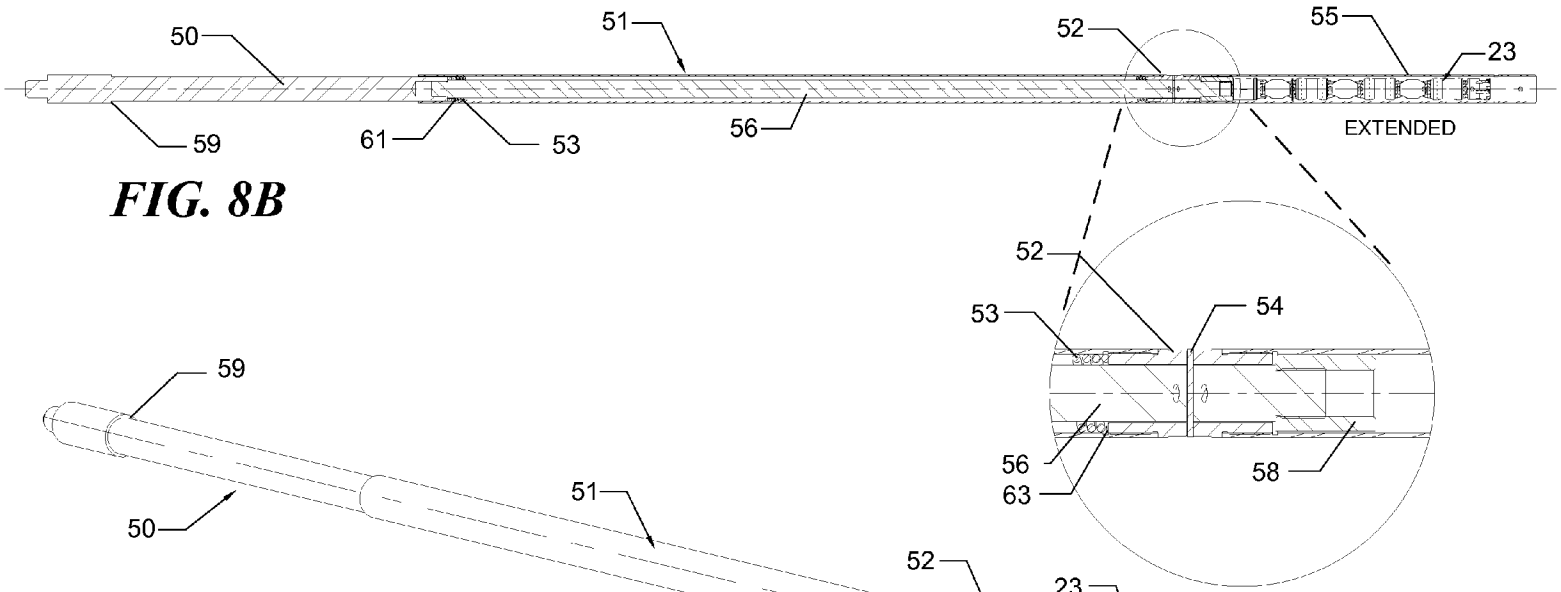
Figure 8A:
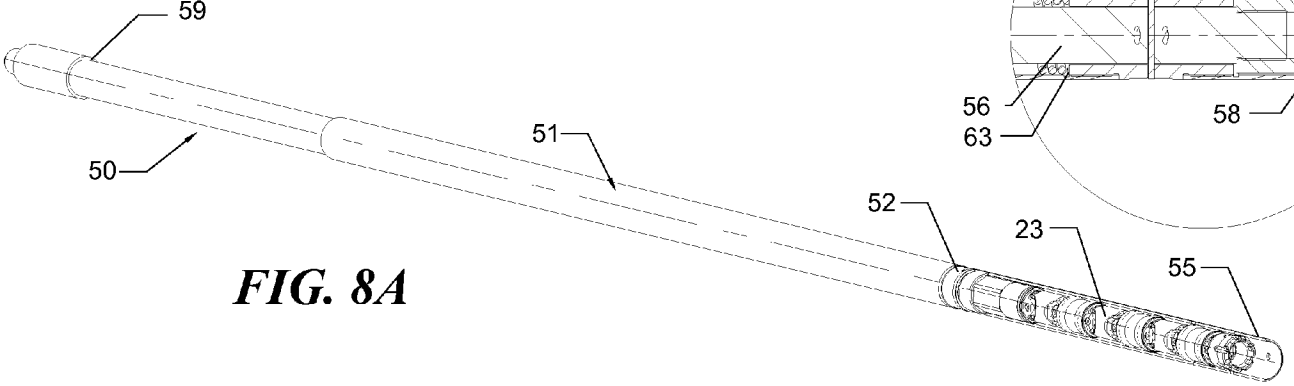

FIGS. 5A, 5B, and 5C respectively illustrate a front end view, a side elevational view, and a cross-sectional view, taken along section line B-B of FIG. 5A, for an exemplary embodiment of a milling cutter head;

FIGS. 6A, 6B, and 6C respectively illustrate a plan view, a side elevational view, and a cross-sectional view taken along section line 6A-6A of FIG. 6A, for an overview of an exemplary split shoe assembly, in a well;

FIG. 7 illustrates an exemplary embodiment of a milling assembly deployment system; and FIGS. 8A, 8B, and 8C respectively illustrate a partially cut-away isometric view, a partial cross-sectional view of the protector assembly extended (with an enlarged portion illustrating details of a portion of an exemplary embodiment of the protector assembly, and a partial cross-sectional view of the protector assembly refracted, for the milling assembly disposed inside a deployment shoe.

DESCRIPTION

Figures and Disclosed Embodiments are not Limiting

Exemplary embodiments are illustrated in referenced FIGURES of the drawings. It is intended that the embodiments and FIGURES disclosed herein are to be considered illustrative rather than restrictive. No limitation on the scope of the technology and of the claims that follow is to be imputed to the examples shown in the drawings and discussed herein. Further, it should be understood that any feature of one embodiment disclosed herein can be combined with one or more features of any other embodiment that is disclosed, unless otherwise indicated.

Exemplary Milling Assembly

Figure 1:
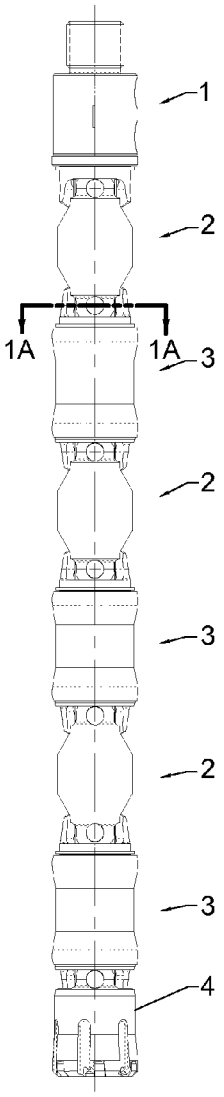
FIG. 1 illustrates an exemplary embodiment of a flexible milling assembly.
Figure 3:
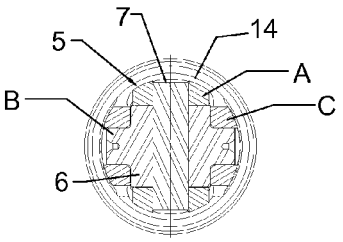
FIG. 3 illustrates a cross section of an exemplary embodiment of a universal joint used in the flexible milling assembly.
Figure 2:
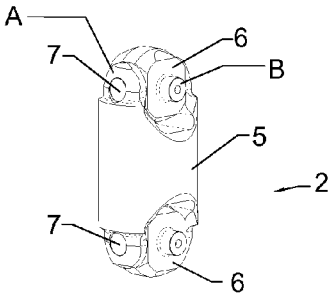
FIG. 2 illustrates an exemplary embodiment of a straight yoke assembly.

Referring to FIG. 1, the flexible milling assembly is shown in a straight or linear configuration. The assembly includes a drive yokel, three straight yoke assemblies 2, three split yoke assemblies 3, and a cutter head 4. An exemplary complete straight yoke assembly 2 is shown in FIG. 2. This straight yoke assembly comprises a straight yoke 5 and two universal blocks 6, which are connected to straight yoke 5 with pivot pins 7. Pivot pins 7 are pressed into universal block 6, but are free to rotate inside ears A of straight yoke 5. A cross sectional view of the universal block taken in the plane formed by the axes of the pins 7 and B (i.e., along section line 1A-1A) is shown in FIG. 3. As shown in FIGS. 2 and 3, the universal blocks incorporate cylindrical projections B that engage with ears C of each of split yoke assemblies 3.

Figure 4:
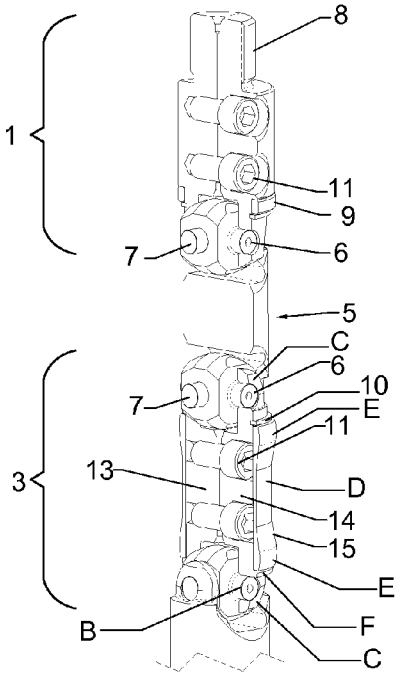
FIG. 4 is a partially sectioned view of the upper portion of the flexible joint assembly.

FIG. 4 shows a partial cross-sectional sectional view of drive yoke 1, a straight yoke assembly 2, and a split yoke assembly 3 to show how the apparatus is assembled. The split yoke assembly includes two halves 13 and 14 that are held together with bolts 11, so that ears C capture pins B on universal block 6. Alignment pins (not shown) further strengthen the assembly. A barrel sleeve 15 may then be slipped over the assembly until it stops at a projection F. A split retaining ring 10 is then installed. The barrel sleeve is thus captured axially, but is free to rotate as a bushing around the bolted assembly. The barrel sleeve further incorporates projections E at the upper and lower ends, and a narrow waist D in its center. Drive yoke 1 is also split and coupled to a straight yoke assembly 2 in the same manner. The drive yoke incorporates a slide ring 9, which acts as a bearing. The uppermost end of drive yoke 1 includes threads 8 that connect to a rotary drive tube (not shown in these Figures).

Several views of cutter head 4 are shown in FIGS. 5A, 5B, and 5C. The cutter head is coupled to the lowermost universal joint block by pivot pin 7 (not shown in these Figures), which slides inside ears A. The front end face of cutter head 4 includes multiple cutters 4*a*, which are preferably fabricated from a hard material such as tungsten carbide or tool steel. In one exemplary embodiment, there are six cutters which are silver brazed to the cutter housing, and the cutter housing is fabricated from steel. The cutter housing is enlarged inside at a point 4*e* (as shown in FIG. 5C), so that the disc of steel 4*f*, which is cored from the well casing, will become trapped inside the cutter housing. After the milling operation is believed to have been completed and flexible milling assembly has been withdrawn from the well casing, the cutter head can be inspected to confirm that the steel disc cored from the well casing has indeed been trapped and retained within the cutter housing. The cutter housing also incorporates an external taper 4*d* to ensure that the cutter housing will not bind on the outer diameter of the cut being created in the well casing. The cutters are preferably positioned with a back rake angle and a small clearance angle, preferably less than 1 degree, that limits the depth of cut that can be made and thereby reduces the reactive torque of the cutting head. A cuttings groove 4*b* and junk slots 4*c* are provided in front of each cutter to ensure adequate cuttings removal.

FIGS. 6A, 6B, and 6C show several views of a split shoe 24, which is used to guide the cutter head toward the well casing. The split shoe is circular in cross section and is divided into two halves 40 and 41. The two halves are aligned with pins (not shown) and fastened together with bolts (also not shown). Threaded pins 48*a* and 48*b* are machined on opposite ends of the split shoe, and the split shoe is coupled to a guide tube 26 by engaging matching threads provided internally on an upper collar 50*a*. A lower collar 50*b* helps ensure alignment and integrity of the split shoe. A curved passage that is circular in cross section is milled into the split shoe and includes straight sections 43 and 45 and curved sections 44 and 46. The curved sections have a uniform curve radius and are tangent to the straight sections to which they are joined. In one exemplary embodiment, the split shoe diameter is about 4.25 inches, the curve diameter is about 1.25 inches, and the curve radius is about 6 inches for both curved sections 44 and 46. In this embodiment, the exit angle of the mill is 70 degrees from vertical. The upset geometry of barrel sleeve 15 is designed so that the waist of the sleeve does not come into contact with the curved passage's interior surface. The barrel sleeves on the milling head slide inside the curved passage without rotating, while the internal components of the flexible mill assembly rotate. An exit 47 of the split shoe includes a replaceable wear guide (not shown) that is disposed at the split shoe exit, and external grooves or passages 49 to enable fluid and milled cuttings to pass the split shoe within the casing and to ease pressure surging, while tripping the shoe into and out of a fluid-filled casing.

FIG. 7 shows an overview of an exemplary milling assembly 23 inside a well casing 29 that extends downwardly within earth 30. The milling assembly is driven to rotate about its longitudinal axis by a power swivel 20 of the type well known in the field of well service. The power swivel is coupled to a prime mover 19 to apply a rotational torque to a string of jointed tubing 21. Those skilled in the art will recognize that the power swivel is suspended from a traveling block on a workover rig (not shown), and the weight of the tubing is supported by the power swivel. Alternate forms of the power swivel can instead be used, as will be readily appreciated by those of ordinary skill in this art. The swivel may be moved up and down by the draw-works of the rig while the string of jointed tubing is rotating. Further, the weight of the assembly can be monitored using load sensors or tension sensors (neither shown) on a cable used to hoist the traveling block. By monitoring the torque level applied to the drive swivel to rotate the flexible milling assembly, and a torsional vibration of the drive line comprising the string of jointed tubing, it is possible to determine when the cutter head on the flexible milling assembly has finished milling an orifice through the well casing.

The string of jointed tubing 21 connects to weight bars 22 adjacent to the milling assembly. The weight bars are coupled to drive yoke 1 at the top of flexible milling assembly 23, to apply a rotational torque to the milling assembly that is transmitted through the string of jointed tubing, which thus serves as a drive line. The flexible milling assembly is shown at the completion of milling a window in well casing 29. The entire rotating assembly, including the string of jointed tubing, weight bars, and flexible milling assembly, is deployed into the well casing though a guide tube 26, which is supported on the earth's surface by slips 27 that wedge into a rotary table 28 that is supported by well casing 29. Alternate means of hanging the guide tube are well known in the industry and this example is only illustrative of one exemplary approach. In one exemplary embodiment, production tubing that was removed from the well for the service work is used as a guide tube. The guide tube is connected at its lower end to a packer 25, which is locked into the well casing. In one exemplary embodiment, the packer is a mechanical type that is set by rotating the guide tube and packer and then pulling upwards on the guide tube to set the packer. This type of packer may be released by rotating the assembly in the opposite direction while lowering the guide tube. Alternative packer mechanisms are well known in the industry and could alternatively be used. The packer supports split shoe 24 in which the curved passage diverts the milling assembly to facilitate milling through the well casing.

In one exemplary embodiment, the weight bars are coupled to the flexible milling assembly through a protector assembly, which is illustrated in FIGS. 8A, 8B, and 8C. An upper rod 50 of the protector assembly connects to one end of the weight bars (disposed on the left—but not shown in these Figures). Upper rod 50 is coupled to the upper end of flexible milling assembly 23 by an inner rod 56 and a coupler 58 (see the enlarged detail of FIG. 8B). An upper sleeve 51, a sleeve coupler 52, and a lower sleeve 55 are freely able to slide axially (i.e., longitudinally) along inner rod 56. As shown in the enlarged detail of FIG. 8B, sleeve coupler 52 is affixed to inner rod 56 with a shear pin 54. This protector assembly encloses and protects the flexible milling assembly while the flexible milling assembly is tripping into and out of the bore hole. When the lower end of lower sleeve 55 engages the upper end of the split shoe, the shear pin shears and releases, enabling the flexible milling assembly to extend into the split shoe. In an exemplary embodiment, the shear pin shears at a force of between about 500 to 2000 lbf, which is sufficient to be detectable at the surface using a string weight indicator. When lower sleeve 55 is fully retracted, it upper sleeve 51 engages a stop 59 on upper rod 50. The extension distance of lower sleeve 55 corresponds to the point at which the mill cutter has fully penetrated the casing and prevents over drilling, which could damage the assembly. A helical spring 53 (not fully shown), which extends between a point 61 and a point 63, causes lower sleeve 55 to extend (as shown in FIG. 8B) to protect the flexible milling assembly when pulling the flexible milling assembly out of the bore hole.

Although the concepts disclosed herein have been described in connection with the disclosed form of practicing them in one or more exemplary embodiments and modifications thereto, those of ordinary skill in the art will understand that many other modifications can be made thereto within the scope of the claims that follow. Accordingly, it is not intended that the scope of these concepts in any way be limited by the above description, but instead be determined entirely by reference to the claims that follow.

The concepts disclosed herein in which an exclusive right is claimed is defined by the following:

1. A flexible joint assembly for use in milling an orifice in a well casing, comprising:

(a) a drive yoke disposed at a proximal end of the flexible joint assembly;

(b) at least one straight yoke assembly;

(c) at least one split yoke assembly;

(d) a bushing disposed about each split yoke assembly and constrained by a split ring so that the bushing is free to rotate about the split yoke assembly; and (e) a cutter head disposed at a distal end of the flexible joint assembly, wherein the drive yoke, the at least one straight yoke assembly, the at least one split yoke assembly, and the cutter head are all flexibly coupled together with a plurality of universal joint blocks.

2. The flexible joint assembly of claim 1, wherein each straight yoke assembly includes a straight yoke, and each split yoke assembly includes a split yoke.

3. The flexible joint assembly of claim 2, wherein at least one of the plurality of universal joint blocks includes integral projecting pins that slidably engage ears extending from an end of a split yoke, and a pivot pin orthogonal to said integral projecting pins that forms an interference fit with said universal joint block and slideably engages ears extending from an end of a straight yoke.

4. The flexible joint assembly of claim 2, wherein the bushing is axially constrained by a projection provided on the split yoke assembly.

5. The flexible joint assembly of claim 2, wherein the cutter head comprises ears at a proximal end that slidably engage a pivot pin that is attached to a distal end of a universal joint block.

6. The flexible joint assembly of claim 2, wherein the cutter head comprises a plurality of cutters fabricated from a material that is harder than the well casing, and wherein the plurality of cutters define an annulus around a distal end of the cutter head, the cutter head including a cavity within the annulus that is sufficiently long to receive a central core of the well casing that is cut away by said cutters.

7. The flexible joint assembly of claim 2, wherein a distal end of the cutter head comprises cutters fabricated from either hardened steel or tungsten carbide.

8. The flexible joint assembly of claim 2, wherein the cutter head includes shallow cutter relief features that limit cutter penetration and thereby limit a torque applied to the cutter head, regardless of an axial thrust load applied to the cutter head.

9. A milling assembly useful for milling an orifice in a well casing, comprising:

a flexible joint assembly that includes a drive yoke couplable to a drive tube that applies a rotational driving force to the flexible joint assembly, the flexible joint assembly including a plurality of straight yoke assemblies, a plurality of split yoke assemblies, and a cutter head, the drive yoke being pivotally joined to one of the plurality of straight yoke assemblies through a universal block, each of the plurality of straight yoke assemblies being pivotally joined to one of the split yoke assemblies through additional universal blocks, a distal most of the plurality of split yoke assemblies being pivotally joined with the cutter head through another universal block;

a cylindrical split shoe having a passage for guiding the flexible joint assembly to bend toward an internal surface of the well casing where the orifice is to be milled; and a protective tubular sleeve that is disposed around the flexible joint assembly, the protective tubular sleeve being coupled to the drive tube by a spring such that the protective tubular sleeve is retained around the flexible joint assembly until the protective tubular sleeve slides back relative to the flexible joint assembly, as the flexible joint assembly enters the cylindrical split shoe, the spring providing an axial force to move the protective tubular sleeve back around the flexible joint assembly as the flexible joint assembly is subsequently withdrawn from the well casing, the cutter head being disposed at a distal end of the flexible joint assembly to contact the internal surface of the well casing and to mill the orifice through the well casing as the drive tube rotates the flexible joint assembly and the cutter head.

10. The milling assembly of claim 9, wherein the drive tube comprises a plurality of lengths of jointed tubing that are driven in rotation by a prime mover that is disposed at the surface.

11. The milling assembly of claim 9, further comprising a plurality of sleeves disposed circumferentially around the flexible joint assembly that serve as bearings, wherein an outer diameter of the sleeves is selected to provide a sliding close fit with an internal diameter of the passage in the cylindrical split shoe, so that the sleeves readily slide through the passage but prevent the flexible joint assembly from buckling when a thrust and torque are applied to drive the cutter head on the flexible joint assembly to mill the orifice through the well casing.

12. The milling assembly of claim 9, further comprising a tubular sleeve that is disposed around the flexible joint assembly, the tubular sleeve being coupled with the drive tube by at least one shear pin, such that when the tubular sleeve engages a proximal end of the cylindrical split shoe, the shear pin is sheared through causing a momentary decrease in a weight of the drive tube that is detectable on the surface, indicating that the flexible joint assembly is proximate to a location where the orifice is to be milled through the well casing.

* * * * *